United States Patent [19]

Arnoux

[11] 4,142,166

[45] Feb. 27, 1979

[54] ARMATURE ASSEMBLY FOR AN ELECTROMAGNETIC RELAY

[75] Inventor: Daniel Arnoux, Saint-Germain-en-Laye, France

[73] Assignee: Manufacture Francaise d'Appareils Electriques de Mesures dite Manumesure, Conches-en-Ouche, France

[21] Appl. No.: 812,601

[22] Filed: Jul. 5, 1977

[30] Foreign Application Priority Data

Jul. 9, 1976 [FR] France ..... 76 20988

[51] Int. Cl.[2] ..... H01H 51/22

[52] U.S. Cl. ..... 335/81; 335/230

[58] Field of Search ..... 335/179, 184, 229, 230, 335/234, 79, 80, 81

[56] References Cited

U.S. PATENT DOCUMENTS

| | | | |
|---|---|---|---|
| 3,792,390 | 2/1974 | Boyd | 335/234 X |
| 3,814,376 | 6/1974 | Reinicke | 335/234 X |
| 3,859,547 | 1/1975 | Massie | 335/234 |

*Primary Examiner*—George Harris

*Attorney, Agent, or Firm*—Jay L. Chaskin

[57] ABSTRACT

An electro-magnet comprising a stationary system having a coil, a core and stationary flux-conductive yokes and with one part movable in longitudinal translation, comprising one permanent magnet whose magentizing axis is perpendicular to the moving direction of said movable part and two flux-conductive armatures secured to each pole face of said magnet in perpendicular relationship to said magnetizing axis, one of said flux-conductive armatures is so bent and/or shaped as to define, two air-gap regions arranged on either side of said magnetizing axis, whereas two yoke ends parallel to said magnetizing axis are placed in said air-gap regions.

10 Claims, 7 Drawing Figures

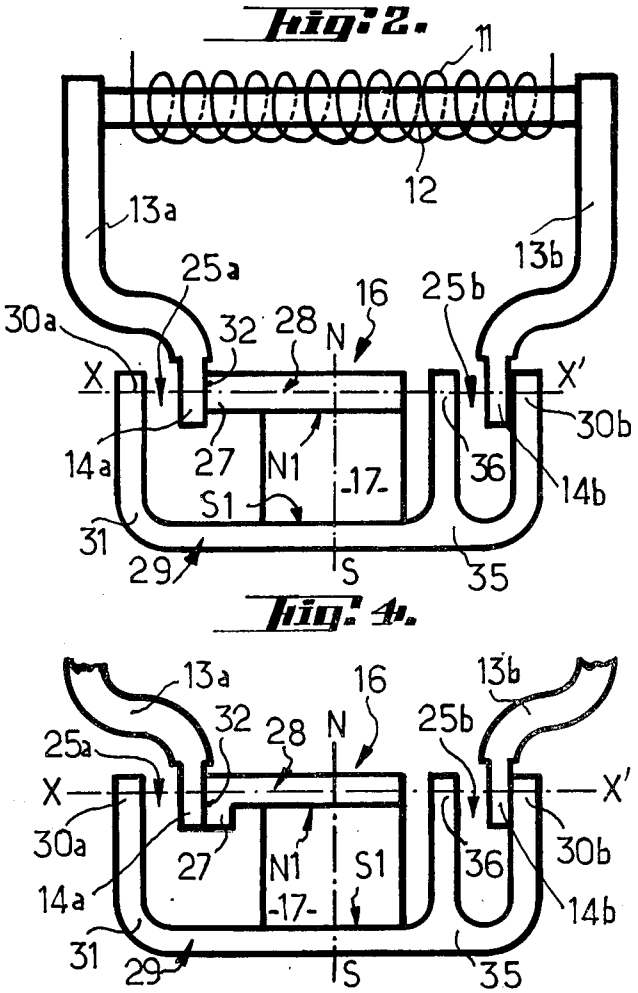
Fig. 2.
Fig. 4.
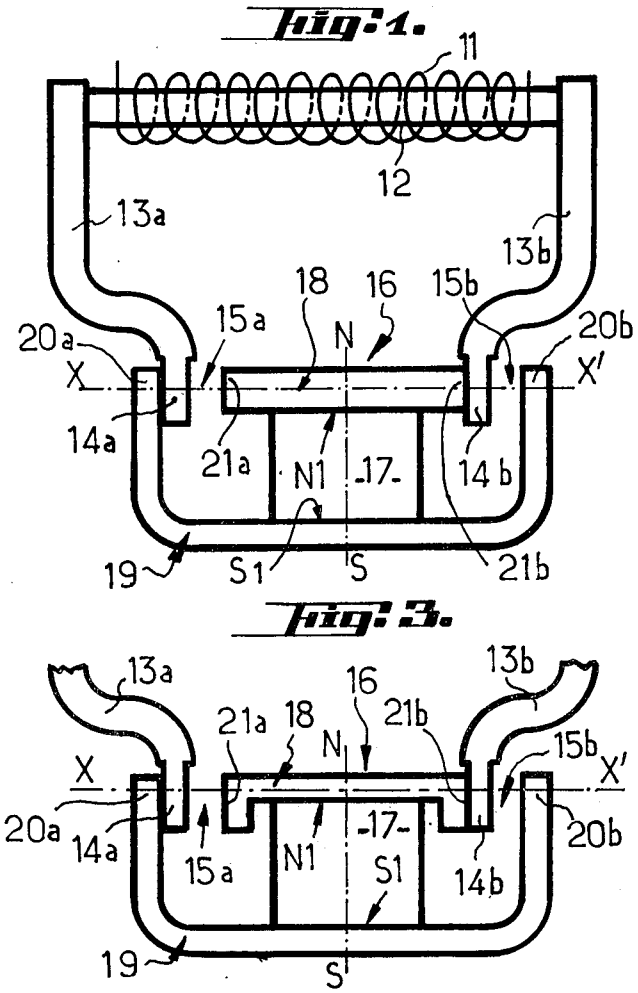
Fig. 1.
Fig. 3.

ARMATURE ASSEMBLY FOR AN ELECTROMAGNETIC RELAY

The present invention relates to electro-magnets and especially to those used in electromagnetic relays. It more particularly has for its object a novel relay structure equipped with such an electro-magnet and remarkably adapted to present-day needs in view of the increasing tendency to develop very small and above all very flat relays capable of being mounted on printed-circuit cards. Moreover, the structure of the relay according to the principle underlying the invention allows excellent insulation to be obtained between the relay coil and contacts. Above all, the structure of the relay comprising one or several permanent magnets is such that it allows a considerable limitation of the irreversible demagnetization during a period of storage or non-use in a cold atmosphere. Lastly, one and the same structure according to the invention can be used either as a bistable relay or a monostable relay by replacing just one piece thereof.

There are known many types of relays using at least one permanent magnet placed in the path of the flux produced by the energizing coil of the relay. In some of such relays there frequently arises the problem of irreversible demagnetization of the magnet in the cold. Now this demagnetization is all the more marked as the reluctance of the magnetic circuit through which the flux from the magnet closes is higher. On the other hand, in practice, a relay is only subjected to low temperatures when it is in a position of storage or non-use. Now in many known systems at least one of the magnets constituting the magnetic circuit has its flux path closing through the air when the movable part of the relay is in the storage position. By "storage position" is meant the stable position assumed by the movable part when the relay is not in service. It is therefore one of the two possible positions of the said movable part if the latter is of the bistable type and it is the single stable position in the case of the monostable type. This results in poor operation when the relay is used after a period of storage in a cold atmosphere, especially where the relay structure comprises several magnets only some of which are demagnetized in the above-mentioned manner. Under the best conditions, poor sensitivity is to be expected if there is a single magnet in the relay structure or in case all the magnets have become demagnetized in the same manner.

The present invention offers the advantage of obviating all such drawbacks, i.e. of providing a type of flat relay that is both reliable in time whatever the storage conditions and so designed as to allow either a bistable-type relay or a monostable type relay to be obtained without considerably modifying the structure. Other important advantages, also resulting from the relay structure according to the invention, will be explained later, as for example the high quality of the insulation between the energizing coil and the break contacts.

According to the invention, all the above advantages are due to the fact that the structure of the relay device is such that, at least in the storage or non-use position of its movable part including the magnets, all the magnets have their flux path closing through flux-conductive metal pieces, and also to the fact that the monostable mode of operation is derived from the bistable structure by merely modifying the shape of the metal pole-pieces or flux-conductive armatures of the movable part of the structure without it being necessary to add return springs urging the same to a predetermined position, the force of the springs of the contacts themselves, acting only at the beginning of the return travel, being sufficient for that purpose.

More specifically, the invention therefore has for its object an electro-magnet device such as that of a relay comprising a stationary system composed of a coil, a core of the coil and stationary flux-conductive yokes at least some of which are connected to the core, and at least one part movable in longitudinal translation and comprising at least one magnet arranged so that its magnetizing axis is perpendicular to the direction of displacement of the movable part and two flux-conductive armatures secured to each pole face, respectively, of the magnet in perpendicular relationship to the magnetizing axis, at least one of the flux-conductive armatures is bent and/or shaped so as to define, possibly with the other armature, two air-gap regions located on either side of the magnetizing axis, whereas two yoke ends parallel to the magnetizing axis are located in the air-gap regions, respectively, so that in at least one stable position of the movable part the end portions of the two armatures are in contact with the two ends of the stationary yokes, such a configuration allowing the magnetic flux circuit of the said magnet to be exclusively constituted by flux-conductive pieces in the stable position.

It should be noted that the above-defined air-gap regions are those regions of the movable part in which the ends of the stationary yokes are placed and that the air gap proper may be created on either side of the said yoke ends depending on the position assumed by the movable part. Furthermore, as will be seen later, an air-gap region may be defined by the opposite surfaces of end portions of the armatures pertaining to two distinct armatures (as, in particular, in the case of the bistable type) or to only one such armature (for one of the air-gap regions of the monostable type). This difference in structure of the armatures is the one mentioned above, which by itself allows either a bistable-type or monostable-type relay to be obtained according to the invention.

The invention will be better understood and other purposes, details and advantages of the latter will appear more clearly from the following explanatory description of several forms of embodiment of devices according to the invention, given solely by way of example with reference to the appended non-limitative drawings wherein:

FIG. 1 diagrammatically illustrates the main members of a bistable electromagnetic relay according to the invention;

FIG. 2 diagrammatically shows the main members of a monostable electromagnetic relay according to the invention;

FIGS. 3 and 4 illustrate modified shapes of the flux-conductive armatures of the movable part of the relays according to the invention shown in FIGS. 1 and 2, respectively;

Figure 5:
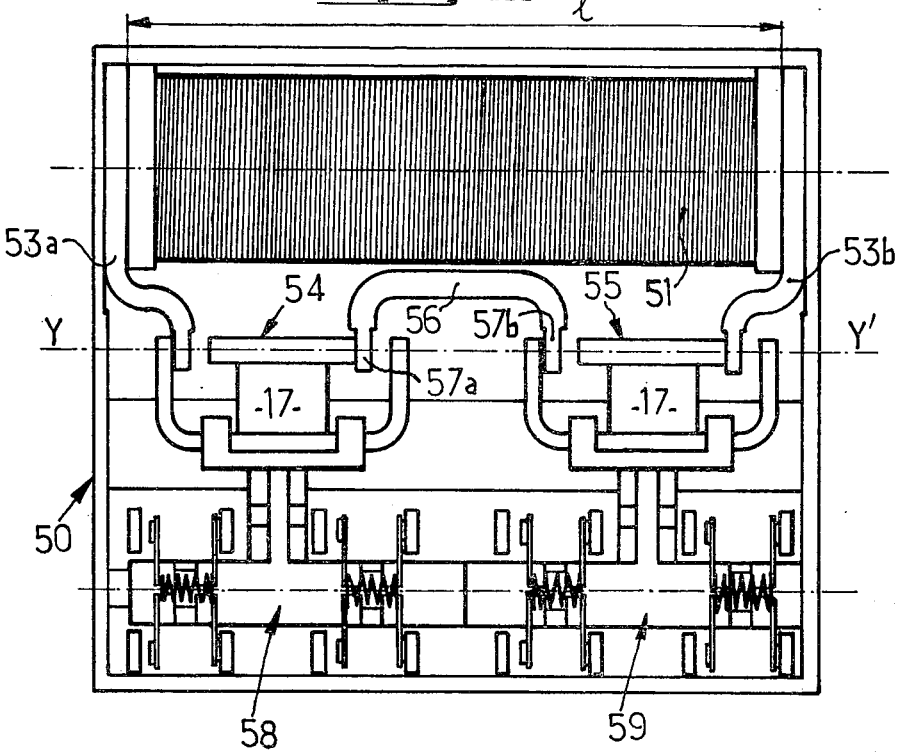
FIG. 5 is a complete, presently preferred, form of embodiment of a bistable relay device according to the invention, showing several identical movable parts associated in series.
Figure 6:
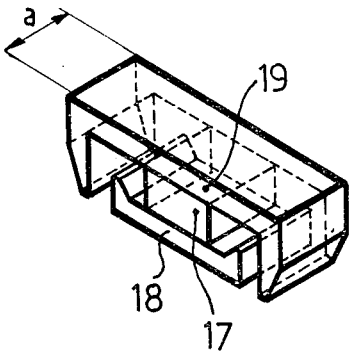
FIG. 6 illustrates another form of embodiment of the portion of the movable part comprising the magnet and the flux-conductive armatures in a bistable-type relay.

Referring to FIGS. 1 and 3, the above-mentioned stationary system of the device according to the invention, which in the case considered is a bistable relay, is made up of an energizing coil 11 with a core 12 passing therethrough and of stationary flux-conductive yokes 13*a*, 13*b* secured respectively to each end of the core. The yokes 13*a*, 13*b* have their ends 14*a*, 14*b* parallel to one another and located in two respective air-gap regions 15*a*, 15*b* of the relay movable part 16 shown partially in FIGS. 1 and 3. The latter is caused to move longitudinally to the right or to the left (in the Figures considered), i.e. in perpendicular relationship to the direction of magnetization N-S of its permanent magnet 17. The movable part 16 also comprises two flux-conductive metal armatures 18, 19 secured to the opposite pole faces $N_1$, $S_1$, of the magnet 17. The movable part 16 is normally completed by a contact support (not shown in FIGS. 1 to 4) rigidly secured to the assembly constituted by the magnet 17 and the armatures 18 and 19. In the bistable relay structure presently described it is seen that the armature 19 is bent on either side of the magnetizing axis N-S to form with the other armature 18 the two air-gap regions 15*a*, 15*b* corresponding to the definition given in the foregoing. More precisely, each of the armatures 18 and 19 forms two arms extending respectively on either side of the magnetizing axis N-S. The ends 20*a*, 20*b* of the arms of armature 19 are bent at right angles towards the respective ends 21*a*, 21*b* of the arms of armature 18 and outside the said ends with respect to the magnet 18. In the structure represented in FIG. 1, the air-gap regions 15*a*, 15*b* are defined between the bent ends of the arms of armature 19 and the edges of the straight ends of the arms of armature 18. In contrast ot this arrangement, the mutually confronting ends 20*a*, 21*a* and 20*b*, 21*b* of the arms of the armatures 18 and 19 shown in FIG. 3 are all bent at right angles towards one another so as to define larger air-gap regions. This, in particular, allows the force which applies or "sticks" the movable part to the ends of the yokes to be adjusted by suitably selecting the dimensions of the mutually confronting surfaces.

In the monostable relay structure according to FIGS. 2 and 4, i.e. the relay structure having a single stable position when the coil is not energized, the stationary system comprising the coil 11, the core 12 and the yokes 13 is not notably modified as compared with the bistable structure. Also the contact support (not shown) connected to the movable part is of the same nature. As a matter of fact, only the structure of the flux-conductive armatures 28 and 29 secured to the magnet 17 is different. Thus, the armature 28 is provided with a single arm 27 (extending towards the left in the Figures considered), whereas the armature 29 has two arms extending on either side of the axis N-S as previously. The end 30*a* of the first arm 31 of the armature 29 is as previously bent at right angles towards the end 32 of the single arm 27 and outside the latter with respect to the magnet 17, so as to define an air-gap region 25*a* identical with the air-gap region 15*a* of the bistable structure. The end 14*a* of the yoke 13*a* is therefore located in this air-gap region. On the other hand, the second arm 35 of armature 29 is provided with two ends 30*b*, 36 parallel with the end 30*a* of the arm 31, so that the air-gap region 25*b* in which the end 14*b* of yoke 13*b* is located is formed between the two parallel ends 30*b*, 36 of the same arm 35. As previously, the end 32 of the single arm 27 may, if desired, be bent at right angles in the direction of the arm 31 to thus define a large air-gap region. This modification is illustrated in FIG. 4.

Figure 7:
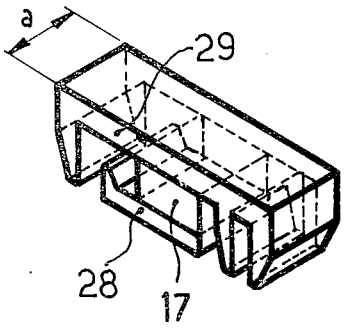
FIG. 7 shows another form of embodiment of the portion of the movable part comprising the magnet and the flux-conductive armatures in a monostable-type relay.

In another respect, the various arms of the metal armatures may be made by any suitable method (e.g. the arms may be welded on or set in a U-shaped member in the case of the monostable structure). FIGS. 7 and 8, however, show two presently preferred forms of embodiment relating to bistable and monostable relays, respectively, wherein the metal armatures 18, 19 and 28, 29 are obtained from correspondingly shaped sections, respectively. Each section is severed to the desired dimensions, i.e. into pieces the length *a* of which corresponds to the width of the pole face of the magnet 17 to which the pieces are thereafter secured.

It should be noted that in the forms of embodiment just described all the air-gap regions 15*a*, 15*b* or 25*a*, 25*b* of one and the same movable part have their centres coinciding with a single axis X—X' parallel with the direction of displacement of the movable part. This eliminates the risk of the latter becoming jammed during an operation as a result of a slight swivelling of its movable part with respect to its normal rectilinear trajectory, which is a frequent occurrence in a great number of known systems where the air-gap regions are distributed on several parallel axes.

FIG. 5 illustrates other advantages and possibilities offered by the invention. This Figure represents a form of embodiment relating to a multi-contact bistable relay 50 comprising a magnetizing coil 51 through which is passed a core whose ends are prolonged by two yokes 53*a*, 53*b*. The complete relay includes two movable parts 54, 55 arranged end to end along their direction of displacement, the air-gap regions being aligned along the axis Y–Y'. This is made possible by simply completing the stationary system defined above with an intermediate yoke 56 having two parallel bent ends 57*a*, 57*b* and arranged between the two movable parts 54 and 55 so that the ends 57*a*, 57*b* are located in the nearest air-gap regions of the adjacent movable parts. The ends of the yokes 53*a*, 53*b* are placed in the farthest air-gap regions of the movable parts 54 and 55. Of course a greater number of movable parts can be provided side by side. It is sufficient, to this end, to accordingly increase the number of intermediate yokes 56, the ends of the yokes 53*a*, 53*b* remaining associated with the farthest air-gap regions of the endmost movable parts. A considerable advantage of such a structure is that a whole range of relays with contacts in variable number can be designed from a small number of standard elements. Indeed, if a movable part is designed to actuate a definite number of contacts (four in the example illustrated in FIG. 5), there is no difficulty in obtaining a whole range of relays, the number of contacts of which will vary as a mutiple of the definite number. It is sufficient, to this end, to provide a set of coils having a constant section and a length *l* substantially proportional to the number of movable parts. Indeed, if, in order to actuate a greater number of contacts, the dimensions of the electro-magnet constituting the relay were simply extrapolated instead of mounting a greater number of movable parts in series, it would be necessary to increase the iron section, which would render the relay unsuitable for use on the printed circuit card, where the height of the relay must, as far as possible, remain constant, Moreover, the core would be very much rectangular in shape, which would contribute to quite unfavourably reduce $N^2/R$ ratio (wherein N is the number of turns of the coil and R its resistance). Great difficulties would also be encountered as regards the mounting of the magnets of the armatures. Last but not least, the benefit of common pieces of standard dimensions, suitable for the various types or designs, would be lost.

Furthermore, it will be noted that in such an arrangement the coil extends in a parallel direction to the direction of displacement of the movable part or parts and that the contact supports 58, 59 completing the movable parts are entirely located on the other side of the region of displacement of the magnets 17, with respect to the side where the coil is mounted. Consequently, the contacts of the relay are all located in the region that is the farthest possible from the said coil. This central region constituted essentially by the metal pieces of the magnetic circuit separates by a continuous screen the region of the contacts from the region where the coil is placed, thus allowing the relay to meet the intrinsic or inherent safety requirements. The operation of the relays described in the foregoing will now be analysed with reference to FIGS. 1 and 2, i.e. as regards a type of relay using a single movable part, it being understood that the operation is the same where several movable parts are arranged in series.

If the relay is of the bistable type and if the movable part 16 is in a stable position, e.g. the one represented in FIG. 1, the flux issuing from the face $N_1$ of the magnet 17 passes through the yoke **13*b*, the core 12, the yoke 13*a* and returns to the magnet through its face $S_1$. Two forces of attraction in the same direction and of the same intensity are produced between the mutually adjacent portions of the ends 14*b* and 21*b* on the one hand and the ends 14*a* and 20*a* on the other. These two complementary forces are directed along the axis X—X' towards the right in FIG. 1 and hold closed the contacts which must be closed in that position, with no exciting current flowing through the coil. If, at a given instant, the coil is energized to produce a flux opposed to that of the magnet 17, repelling forces appear at the said contacting portions and cause the movable part 16 to move in translation until the ends 14*a* and 14*b* themselves produce an attraction force with the ends 21*a*, 20*b* of the armatures. As the relay is of the bistable type, the current in the coil can be interrupted after the said translation, but the removable part 16 remains in this latter position. Of course a current in the opposite direction through the coil will cause a further movement of the movable part. Moreover and as mentioned previously, irrespective of the position assumed by the movable part 16, in particular when the relay is not in use or is stored in a cold atmosphere for a long period of time, the path of the flux from the magnet 17 closes exclusively through metal pieces constituted by the entire yokes 13*a*, 13*b* and core 12 and part of the armatures 18 and 19**.

As regards the monostable relay, it is seen that when the movable part 16 is in the position shown in FIG. 2, the system behaves in the same manner as in the bistable device. Otherwise stated, the flux flowing through the armature 28, the yoke **13*a*, the core 12, the yoke 13*b*, the end 30*b* of the armature 35 and returning to the magnet 17 through its face $S_1$ produces in the air-gap regions 25*a* and 25*b* equal attraction forces acting in the same direction and holding the movable part 16 in that position. The latter, therefore, is the single stable position of the monostable relay. When a current is caused to pass in the correct direction through the coil 11 so as to produce a flux opposite to that of the magnet 17, there takes place, as previously, a reversal of the direction of the acting forces in both air-gap regions 25*a*, and 25*b*. In this position, however, the new forces are produced without the flux due to the coil having to pass through the magnet 17, in view of the direct linking provided by the special structure of the armature 35. In this manner, when the current through the coil 11 is cut off, the reaction of the compressed operating contacts is sufficient to cause the removable part 16 to return to its previous stable position. Of course this return movement of the movable part is completed by the attraction force which is then again exerted by the magnet 17 and, at the end of the travel, allows the compression of the rest contacts (i.e. the contacts that are closed when the coil is not energized) of the relay. Also in this case, when a relay of such a type is stored or is not used for a certain period of time, the movable part 16, as appears from the foregoing, is necessarily in the position shown in FIG. 2 and the path of the flux from the magnet 17** is entirely constituted by metal elements. During normal operation, the temperature of the ambiant air is higher and the evolution of heat from the devices, apparatuses or equipment in operation prevents the magnet from becoming irreversibly demagnetized.

Of course, the invention is by no means limited to the forms of embodiment of the devices just described. It comprises all the technical equivalents to the means used if the latter are used within the scope of the following claims.

What is claimed is:

1. An electromagnetic device having a coil, a stationary core passing through the coil and a plurality of stationary flux-conductive yokes, at least some of the yokes being connected to the core and at least one part being movable in longitudinal translation and spaced from the coil;

at least one permanent magnet having poles forming a single magnetic axis arranged perpendicular to the direction of displacement of the movable part; a flux-conductive armature secured to each magnet pole and perpendicular to the magnetic axis, at least one of the flux-conductive armatures shaped to define air-gap regions arranged on either side of the magnetic axis;

the stationary flux-conductive yokes having two ends parallel to the magnetic axis and located in respective air-gap regions; each flux-conductive armature having a respective end portion in contact with a respective stationary flux-conductive yoke end in at least one stable position of the movable part wherein the flux path of the magnet is defined exclusively in the stable position by flux-conducting elements.

2. A device according to claim 1 having a single stable position when the coil is not energized wherein a first flux-conductive armature forms a single arm extending on one side of the magnetic axis and a second flux-conductive armatures forms two arms extending on either side of the magnetic axis, an end of a first arm of the second armature extending in the same direction as the single arm of the first armature, the first arm being bent at right angles towards an end of the single arm and spaced from the single arm with respect to the magnet, and a second arm of the second armature being provided with two ends parallel to the end of the first arm, the two ends of the yokes being arranged respectively between the end of the single arm and that of the first arm and the two parallel ends of the second arm.

3. A device according to claim 1, wherein the air-gap regions have their respective centres coincident with a single axis parallel to the direction of displacement of the movable part.

4. A device according to claim 1, having two stable positions when the coil is not energized, wherein each fluxconductive armature has an arm extending on either side, respectively, of the magnetic axis, at least one end of one of the arms of the armature is bent at right angles towards the end of the corresponding arm of the other armature and spaced from the corresponding arm with respect to the magnet, the two yoke ends being arranged respectively between the confronting ends of the armatures, on either side of the magnetic axis.

5. A device according to claim 4, wherein the confronting ends of the armatures on either side of the magnetic axis are both bent at right angles towards one another to define larger air-gap regions.

6. A device according to claim 2, wherein the end of the single arm is bent at right angles in the direction of the first arm, to define a larger air-gap region.

7. A device according to claim 1, wherein at least one of the flux-conductive armatures is made from a suitably shaped section severed to the desired dimensions corresponding to the width of the magnet pole face to which the severed section is thereafter secured.

8. A device according to claim 1, wherein in that the coil is arranged in substantially parallel relationship to the direction of displacement of the movable part, the movable part having a contact support entirely located on the other side of the region of displacement of the magnet, with respect to the coil.

9. A device according to claim 8, comprising a plurality of movable parts arranged end to end along the direction of displacement, and intermediate yokes having two parallel bent ends are arranged between two adjacent movable parts, the intermediate yoke ends being located respectively in the nearest air-gap regions of the adjacent movable parts, the yoke ends connected to the core of the coil being located respectively, in the farthest air-gap regions of the two endmost movable parts.

10. A device according to claim 9, wherein the length of the coil is substantially proportional to the number of said movable parts.

* * * * *